United States Patent [19]

Stanier

[11] 4,428,813

[45] Jan. 31, 1984

[54] CLADDING CATHODES OF ELECTROLYTIC CELL WITH DIAPHRAGM OR MEMBRANE

[75] Inventor: Colin Stanier, Northwich, England

[73] Assignee: Imperial Chemical Industries PLC, London, England

[21] Appl. No.: 353,421

[22] Filed: Mar. 1, 1982

[30] Foreign Application Priority Data

Mar. 10, 1981 [GB] United Kingdom ..... 8107413

[51] Int. Cl.[3] ..... C25B 9/00; C25B 13/02; B29H 5/26; B29C 27/04

[52] U.S. Cl. ..... 204/253; 204/283; 204/295; 204/296; 156/273.7; 156/274.4; 264/26

[58] Field of Search ..... 204/253–258, 204/263–266, 282–283, 295–296; 264/26, 25; 156/273.7, 274.4, 273.3, 380.6; 53/DIG. 2

[56] References Cited

U.S. PATENT DOCUMENTS

| | | | |
|---|---|---|---|
| 3,468,736 | 9/1969 | Porter | 156/273.3 |
| 3,878,082 | 4/1975 | Gokhale | 204/252 X |
| 3,923,630 | 12/1975 | Argade et al. | 204/296 X |
| 3,980,544 | 9/1976 | Adams et al. | 204/286 |
| 4,135,957 | 1/1979 | Voller | 156/274.4 X |
| 4,219,394 | 8/1980 | Babinsky et al. | 204/296 X |
| 4,263,121 | 4/1981 | Christensen | 204/296 |
| 4,283,264 | 8/1981 | Darling et al. | 204/296 X |
| 4,318,785 | 3/1982 | Gunjima et al. | 156/308.2 X |
| 4,329,217 | 5/1982 | Byrd et al. | 204/252 |

FOREIGN PATENT DOCUMENTS

| | | |
|---|---|---|
| 8165 | 2/1980 | European Pat. Off. . |
| 2044802A | 10/1980 | United Kingdom . |

*Primary Examiner*—Donald R. Valentine

*Attorney, Agent, or Firm*—Cushman, Darby & Cushman

[57] ABSTRACT

A method of cladding a separator, that is a diaphragm or membrane, to a cathode box of the pocket type comprising a plurality of foraminate walls, the method comprising positioning a separator in the form of a sleeve in each pocket of the cathode box with the ends of the sleeves projecting beyond the ends of the pockets and heat sealing by means of radio frequency heating those parts of the sleeves projecting beyond the ends of adjacent pockets, either to each other or to additional heat sealable material. Also a cathode box clad with separator, and an electrolytic cell comprising a cathode box clad with separator.

12 Claims, 9 Drawing Figures

CLADDING CATHODES OF ELECTROLYTIC CELL WITH DIAPHRAGM OR MEMBRANE

Figure 1:
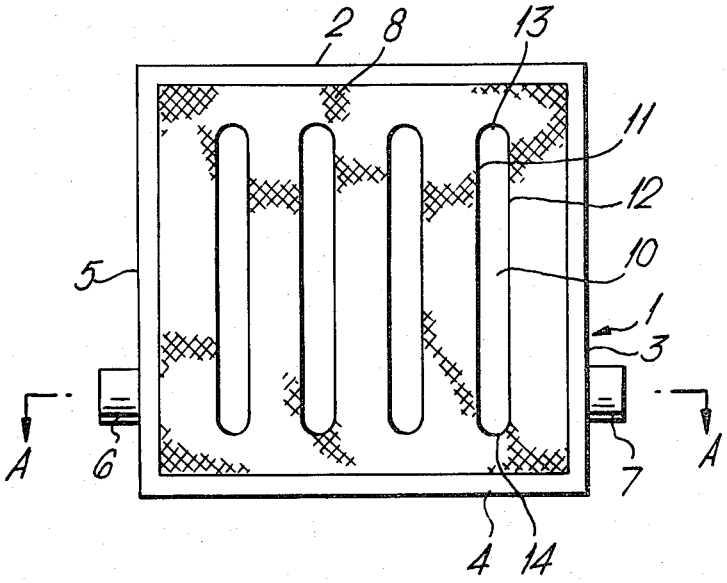

This invention relates to a method of cladding a cathode box of an electrolytic cell with a diaphragm or membrane, to a cathode box clad with diaphragm or membrane, and to an electrolytic cell comprising a cathode box clad with diaphragm or membrane.

The cathodes clad with diaphragm or membrane in the method of the invention are of the type generally useful in electrolyte cells for the electrolysis of aqueous alkali metal chloride solution to produce chlorine and alkali metal hydroxide solution, especially the production of chlorine and sodium hydroxide solution by the electrolysis of aqueous sodium chloride solution. However, it is to be understood that the invention is not so limited and that the cathodes so clad with diaphragm or membrane may be used in electrolytic cells for the electrolysis of ionisable chemical compounds other than aqueous alkali metal chloride solutions.

Such electrolytic cells may comprise a cathode box having side walls and plurality of cathode fingers or pockets, and within the box a plurality of anodes evenly spaced from each other and generally parallel to each other and fixed to a base, the anodes being positioned between adjacent cathode fingers or in the cathode pockets of the cathode box. A hydraulically permeable diaphragm material or an ionically permselective membrane material is positioned on the cathode fingers or in the cathode pockets and divides the cell into separate anode and cathode compartments. The cathode fingers or pockets may have a foraminate structure, and the cell is equipped with a top or header through which aqueous electrolyte solution may be fed to the cell and with means for removing the products of electrolysis from the cell.

For many years the foraminate structures in cathode boxes of electrolytic cells have been clad with asbestos diaphragms by immersing the cathode box in a suspension of asbestos fibres in, for example, cell liquor, and drawing the asbestos fibres by suction onto the foraminate structure. A hydraulically permeable mat of asbestos fibres is thereby formed on the foraminate structure of the cathode box. Although such asbestos diaphragms have been used for many years, and of course continue to be used on a large scale, there is a need to replace asbestos diaphragms by other materials which do not swell during use in electrolysis. Thus, where aqueous alkali metal chloride solution is electrolysed in a cell equipped with an asbestos diaphragm the anode-cathode gap must be greater than is desirable, with consequent increase in voltage, at least in part to provide for the swelling of the asbestos diaphragm which takes place during electrolysis. There is also a need to replace asbestos by materials which do not have the toxic properties of asbestos and which have a longer effective lifetime than asbestos.

Many different types of hydraulically permeable diaphragms made of synthetic polymer materials have been proposed. For example, in British Pat. No. 1,081,046 in the name of Imperial Chemical Industries Limited there is described a sheet diaphragm of porous polytetrafluoroethylene which is produced by forming a sheet of polytetrafluoroethylene and a particulate filler, e.g starch, and extracting the filler from the sheet. In British Pat. No. 1,503,915, also in the name of Imperial Chemical Industries Limited, there is described an electrochemical cell, particularly suitable for use in the production of chlorine and alkali metal hydroxide by the electrolysis of aqueous alkali metal chloride solution, the cell comprising an anode and a cathode separated by a porous polytetrafluoroethylene diaphragm which has a microstructure of nodes interconnected by fibrils. A porous sheet of polytetrafluoroethylene having the aforementioned microstructure and suitable for use as a diaphragm, and a method of producing the sheet, are described in British Pat. No. 1,355,373 in the name of W L Gore and Associates Inc.

In recent years a number of substantially hydraulically impermeable ionically permselective membrane materials have been developed, particularly for use in electrolytic cells for the electrolysis of aqueous alkali metal chloride solutions where it is desired to produce alkali metal hydroxide solution substantially free of alkali metal chloride. These membrane materials generally comprise fluorine-containing polymeric materials containing cation-exchange groups, for example, sulphonic acid, carboxylic acid or phosphonic acid groups, or derivatives thereof. The polymeric materials may be perfluorinated, and the cation-exchange groups may be present in units derived by polymerisation of perfluorovinylethers containing the cation-exchange groups. Such cation-exchange membranes are described, for example, in British Pat. Nos. 1,184,321, 1,402,920, 1,406,673, 1,455,070, 1,497,748, 1,497,749, 1,518,387 and 1,531,068.

Many of the synthetic diaphragms and membranes which have been developed cannot be applied to the foraminate cathodes of electrolytic cells by the techniques which have hitherto been used to apply asbestos diaphragms to such foraminate structures. In particular a synthetic diaphragm or membrane in the form of a sheet is difficult to apply to a cathode box in which the foraminate cathodes are in the form of a plurality of fingers or pockets. It is difficult to ensure that the diaphragm or membrane conforms to the somewhat irregular shape of the surfaces of such cathode boxes and it is also difficult to ensure that the diaphragm or membrane is adequately sealed so that it is free of leaks. Special techniques have had to be developed to clad such cathode boxes with synthetic diaphragm or membrane.

Many of the techniques hitherto proposed involve the use of mechanical clamping devices.

Thus, in Belgian Pat. No. 864 400 in the name of the Olin Corporation there is described a sheath for cladding an essentially rectangular electrode, the sheath having a closed end, an open end, and two closed sides, at least one of the closed sides consisting of a main section and a section in the form of a lug, the lug being adjacent to the open end. In use the sheath is placed over the cathode and the lug, which is flexible, is bent or twisted to form an essentially flat surface, and methods of clamping or gripping are applied for sealing the sheaths along their upper and lower edges. The sheaths described are suitable for use in the cladding of a cathode box containing a plurality of cathodes of the finger type.

In the U.S. Pat. No. 3,980,544, also in the name of the Olin Corporation, there is described a diaphragm in the form of an envelope which is suitable for cladding foraminate electrodes, especially cathodes, which are positioned parallel to each other and which have a space between each electrode, the diaphragm envelope having an open end and having two adjoining edges which are clamped between a clamping element and a bar positioned between the electrodes. This diaphragm structure and clamping method is particularly suitable for cladding of finger type electrodes.

In U.S. Pat. No. 3,878,082 in the name of BASF Wyandotte Corporation there is described a means for cladding cathodes of both the finger type and the pocket type. In a cathode box comprising cathodes of the finger type a diaphragm in the form of an evelope is positioned over the cathode finger and a U-shaped retainer is positioned over the diaphragm at the junction between adjacent cathode fingers. In a cathode box of the pocket type the diaphragm is wrapped over the cathode and retained in the pocket by means of crescent shaped retainers positioned over the diaphragm in the pocket. U-shaped retainers are also placed over the diaphragm, the U-shaped retainers also cooperating with the cresent shaped retainers.

There have been a number of prior proposals in which the means of cladding the cathode box necessitates the use of slotted support members positioned respectively above and below the upper and lower surfaces of the cathode box with the slots in the support members being aligned with the pockets in the cathode box.

In such cladding methods a sleeve of diaphragm or membrane is placed in each pocket of the cathode box and sealed to the upper and lower support members.

The sleeves of the diaphragm or membrane may be sealed to the support members, for example by clamping the sleeve to upstanding lips on the slotted support members, as described in European Patent Publication No. 0008165 in the name of Imperial Chemical Industries Ltd, or by clamping flared ends on the sleeves to the support members, as described in published British Patent Application No. 2,044,802A in the name of Kanegafuchi.

There have also been prior proposals to heat seal sleeves of diaphragm or membrane to slotted support members, as proposed for example in the aforementioned British Patent Application No. 2,044,802A, and in Belgian Pat. No. 865864 in the name of Imperial Chemical Industries Ltd.

The present invention provides a method of cladding a cathode box comprising a plurality of foraminate cathodes of the pocket type with a diaphragm or membrane which method is particularly effective and which does not rely on the provision of shaped mechanical clamping means to position and seal the diaphragm or membrane in the cathode box. The method of the invention employs a particular type of heat sealing which, as will be explained hereafter, does not suffer from the disadvantages of conventional heat sealing in which heated platens are used.

The method of cladding of the present invention is suitable for use in the cladding of a cathode box comprising a plurality of foraminate cathodes of the pocket type by which we mean a cathode box having side walls, a top and a bottom which may have a foraminate structure, and a plurality of pockets substantially parallel to each other and formed by foraminate walls positioned between the top and bottom, the pockets forming cavities in which the anodes of an electrolytic cell may be positioned. The pockets, in plan view, are generally but not necessarily elongated in shape having two substantially parallel and relatively long side walls and two relatively short end walls joining the side walls.

According to the present invention there is provided a method of cladding a cathode box of the pocket type for use in an electrolytic cell in which method a separator in the form of a sleeve is positioned in each pocket of the cathode box with the ends of the sleeves projecting beyond the ends of the pockets, characterised in that those parts of the sleeves projecting beyond the ends of adjacent pockets in a first direction are heat sealed to each other or to additional heat sealable material, those parts of the sleeves projecting beyond the ends of adjacent pockets in the opposite direction are heat sealed to each other or to additional heat sealable material, and in that the heat sealing is effected by means of radio frequency heating.

Unless otherwise stated we will for simplicity refer hereafter to "separators", and it is to be understood that the term "separators" as used includes both hydraulically permeable materials, commonly referred to as diaphragms, which permit electrolyte to flow between the anode and cathode compartments of an electrolytic cell, and substantially hydraulically impermeable ionically permselective materials, commonly referred to as membranes, which permit the selective transfer of ionic species between the anode and cathode compartments of an electrolytic cell. Within the scope of the term "diaphragm" we also include materials which may not be hydraulically permeable but which may readily be converted to a hydraulically permeable form, for example, by extraction of a particulate substance from the material. Within the scope of the term "membrane" we include materials which are not ionically permselective but which may readily be converted to an ionically permselective form, for example by hydrolysis.

Conventional heat sealing in which the material to be heat sealed, for example the projecting parts of the separator sleeves in adjacent pockets of the cathode box, are positioned between heated platens and heat is transferred to the material from the platens suffers from disadvantages. Thus uniform heating throughout the thickness of the material is difficult to achieve as heat has to be transferred through the separator material, which has low thermal conductivity from the surface in contact with the heated platen to the surface to be heat sealed. There may be excessive flow of separator material with resultant distortion of the seal and danger of leakage of electrolyte through the parts which are sealed when the clad cathode box is used in an electrolytic cell. Also the platens expand on heating and, particularly where they are of non-linear shape, for example where they are in part curved, they may be distorted with the result that there may be incomplete sealing and resultant leakage of electrolyte through the parts which are incompletely sealed. Furthermore, the separator material which is in contact with the heated platens may adhere to the platens and an unsatisfactory seal may result.

By way of contrast, where heat sealing is effected by means of radio frequency heating uniform heating throughout the thickness of the separator material is readily achieved and the danger of excessive flow and distortion of the material at the seal is much reduced or eliminated, and as the electrodes used to effect the radio frequency heating are not themselves heated, the possibility of distortion of the electrodes and sticking of the separator material to be heat sealed to the electrodes is much reduced or eliminated. In short, the use of radio frequency heating to effect heat sealing produces a much more satisfactory seal with a much reduced danger of leakage of electrolyte occurring when the clad cathode box is used in an electrolytic cell.

Heat sealing of plastics materials by means of radio frequency heating is a technique known per se. However, the use of radio frequency heating has not hitherto been proposed in the cladding of a cathode box with a separator material in the manner described in the present invention, nor have the advantages which follow from the use of radio frequency heating in this particular application previously been suggested.

In effecting heat sealing by means of radio frequency heating the separator material to be heat sealed, for example, the projecting parts of the separator sleeves in adjacent pockets of the cathode box, is placed between and in contact with a pair of electrodes, a high frequency alternating magnetic field is created between the electrodes, and heating is effected by means of dielectric loss in the material. The sealing may be assisted by the application of pressure through the electrodes to the material to be sealed. The frequency of the alternating current applied to the electrodes will generally be in the megacycle range, for example, between 1 and 100 megacycles per second. In general a frequency in the range of 10 to 50 megacycles per second will be suitable. The time required for effecting a heat seal will depend in part on the nature of the material to be heat sealed, and in particular on its softening point, and suitable times, and frequencies, may be determined by means of simple experiment, for example on small samples of the separator material to be heat sealed.

The separator in the form of a sleeve may be made from a separator material in sheet form, for example, by sealing together opposite edges of a sheet of square or oblong shape. The opposite edges may be overlapped, or they may be contacted with a strip of a suitable material and sealed thereto. The sealing may be by heat sealing, for example, and preferably is effected by means of radio frequency heating.

In the method of the invention those parts of the separator sleeves which project beyond the ends of adjacent pockets are heat sealed to each other or to an additional heat sealable material in order that not only the pockets of the cathode box but also the upper and lower surfaces of the cathode box may be clad so that, when the cathode box is installed in an electrolytic cell the cell is divided into separate anode and cathode compartments.

There are several distinct methods by which this cladding may be achieved.

The ends of the sleeves may be flared with the flared ends of each sleeve projecting beyond the ends of the pocket of the cathode box in which each sleeve is placed, and the flared ends of sleeves in adjacent pockets may be placed in contact and heat sealed to each other by means of radio frequency heating. Such a sealing is relatively simple to effect as linear contact between adjacent flared ends may generally be effected and the heat sealing apparatus may comprise two linear electrodes. Suitably shaped flared ends may be sealed to the sleeve and may be made of a separator material, which may be the same as or different from that of the sleeve itself. Alternatively, the flared ends may be made of a material, e.g a plastics material, which is heat sealable but which is neither hydraulically nor ionically permeable.

Alternatively, the separator may comprise a sleeve portion and a plurality of tabs on both edges of the sleeve portion, the dimensions of the sleeve portion being such that, when the separator is positioned in a pocket of the cathode box, the edges of the sleeve portion and the tabs thereon project beyond the extremities of the pocket.

Such a separator is described in our European Patent Application No. 80 302169.0, now published as publication No. 0023094. The projecting edges of the sleeve portion and the tabs thereon may be sealed by radio frequency heating to the projecting edges and the tabs thereon of sleeve(s) in adjacent pocket(s) of the cathode box.

The projecting parts of each of the sleeves may be heat sealed by radio frequency heating to slotted sheets of a heat sealable material positioned over those faces of the cathode box containing the ends of the pockets, that is the upper and lower surfaces, with the slots in the sheet materials being positioned adjacent to the ends of the pockets. For example, the sheet material may comprise upstanding lips adjacent to the slots therein and the ends of the sleeves may be heat sealed to the lips by radio frequency heating using suitably shaped cooperating electrodes.

The slotted sheet materials may themselves be made of a separator material. Thus, where the sleeves are diaphragms made of a material which is hydraulically permeable the slotted sheet materials may also be made of a material which is hydraulically permeable and which functions as a diaphragm, which latter material may be the same as or different from that of the sleeves. Where the sleeves are membranes made of a material which is substantially hydraulically impermeable and which is ionically permselective the slotted sheet materials may also be made of a material which is hydraulically impermeable and ionically permselective and which functions as a membrane, which latter material may be the same as or different from that of the sleeves.

Where the sleeves are diaphragms the slotted sheet materials may even be made of a membrane material. However, where the sleeves are made up of a membrane material the slotted sheet material should be hydraulically impermeable.

Alternatively, the slotted sheet material may be neither a diaphragm nor a membrane material and may comprise, for example, a heat sealable organic polymeric material which is neither hydraulically nor ionically permeable. The organic polymeric material is preferably resistant to the conditions prevailing in the electrolytic cell, and is preferably a fluorine containing polymeric material, e.g poly (vinylidene fluoride) or fluorinated ethylene-propylene copolymer, particularly where the clad cathode box is to be used in an electrolytic cell for the electrolysis of aqueous alkali metal chloride solution. Preferably, the sheet material is a perfluoro organic polymeric material, for example, polytetrafluoroethylene or a tetrafluoroethylenehexafluoropropylene copolymer.

The electrodes should be suitably shaped in order to carry out the heat sealing. Thus, where the ends of the sleeve are to be sealed to upstanding lips on the slotted sheet material the electrodes will have a shape similar to that of the slots, and in operating the heat sealing an inner electrode will co-operate with a similarly shaped but somewhat larger outer electrode with the ends of the sleeves and the lips of the sheet material being positioned between the electrodes.

The projecting parts of each of the sleeves may be heat sealed by radio frequency heating to unslotted sheet materials positioned over those faces of the cathode box containing the ends of the pockets, that is over the upper and lower surfaces of the cathode box. After the heat sealing has been effected, those parts of the sheet materials adjacent to the ends of the pockets and in-board of the seals may be removed. In order to heat seal a sleeve to one of the sheet materials, one electrode is positioned within a pocket of the cathode box in-board of the sleeve and the end of the sleeve is inwardly flared or folded over the end of the electrode. Another electrode is placed on top of the sheet material with the sheet and the flare on the sleeve being located, in contact with each other, between the electrodes. The electrode positioned in the cathode pocket will have a shape similar to that of the pocket of the cathode box.

After the heat sealing has been effected the part of the sheet in-board of the seal is removed and a similar procedure is followed in order to seal the sleeve at the opposite end to a second sheet material.

The sheet material will of course be heat sealable and it may be a separator material or heat-sealable organic polymeric material which is neither hydraulically nor ionically permeable, as hereinbefore described.

The material of the separator should of course be a material which is heat sealable by means of radio frequency heating.

Where the separator is a hydraulically permeable diaphragm it may be made of a porous organic polymeric material. Preferred organic polymeric materials are fluorine-containing polymeric materials on account of the generally stable nature of such materials in the corrosive environment encountered in many electrolytic cells. Suitable fluorine-containing polymeric materials include, for example, polychlorotrifluoroethylene, fluorinated ethylene-propylene copolymer, and polyhexafluoropropylene. A preferred fluorine-containing polymeric material is polytetrafluoroethylene on account of its great stability in corrosive electrolytic cell environments, particularly in electrolytic cells for the production of chlorine and alkali metal hydroxide by the electrolysis of aqueous alkali metal chloride solutions. Such hydraulically permeable diaphragm materials are known in the art.

Where the separator is a substantially hydraulically impermeable ionically perm-selective membrane capable of transferring ionic species between the anode and cathode compartments of an electrolytic cell the membrane is preferably cation selective. Such materials are known in the art and are preferably fluorine-containing polymeric materials containing anionic groups. The polymeric materials preferably are fluorocarbons containing the repeating groups $$\left[C_mF_{2m}\right]_M \text{ and } \left[CF_2-\underset{\underset{X}{|}}{CF}\right]_N$$

where m has a value of 2 to 10, and is preferably 2, the ratio of M to N is preferably such as to give an equivalent weight of the groups X in the range 600 to 2000, and X is chosen from $$A \text{ or } \left[OCF_2-\underset{\underset{Z}{|}}{CF}\right]_p A$$

where p has a value of for example 1 to 3, Z is fluorine or a perfluoroalkyl group having from 1 to 10 carbon atoms, and A is a group chosen from the groups:

—$SO_3H$
—$CF_2SO_3H$
—$CCl_2SO_3H$
—$X^1SO_3H$
—$PO_3H_2$
—$PO_2H_2$
—COOH and
—$X^1OH$ or derivatives of the said groups, where $X^1$ is an aryl group. Preferably A represents the group $SO_3H$ or —COOH. $SO_3H$ group-containing ion exchange membranes are sold under the trade name 'Nafion' by E I du Pont de Nemours and Co Inc and —COOH group-containing ion exchange membranes under the trade name 'Flemion' by the Asahi Glass Co Ltd.

Where the membrane is made of a fluorine-containing polymer containing ion-exchange groups in the form of metal salts of acidic groups, for example in the form of alkali metal salts of sulphonic, carboxylic or phosphonic acids, difficulty may be experienced in heat sealing the membrane by radio frequency heating. In order to facilitate the heat sealing the acidic groups are preferably in the hydrogen form, in the form of acid halide groups, or in the form of lower alkyl esters. Subsequent to heat sealing the groups may be converted to an ion-exchanging form, e.g a metal salt form.

The cathode box may comprise a large number of pockets, for example up to 50 pockets, into each of which a sleeve is positioned and it is desirable to provide some means for retaining the sleeves in position in the pockets of the cathode box prior to effecting the heat sealing. Such a means may be provided by an inflatable bag positioned in each pocket and inflated sufficiently to hold the sleeve in contact with the walls of the cathode pocket. After use the bag may be deflated and removed.

The cathode box clad with separator in the method of the invention may form part of an electrolytic cell. The cathode box may be equipped with a port or ports for removing cell liquor and gaseous products therefrom, and with a port through which liquid, e.g water, may be charged to the cathode box. The foraminate surfaces of the cathode box may be of expanded metal, perforated, or of a woven or net structure. The cathode box, and particularly the foraminate surfaces thereof, may be made of steel, e.g mild steel, or of nickel, especially in the case where the electrolytic cell is to be used in the electrolysis of an aqueous alkali metal chloride solution.

The anodes in the electrolytic cell may suitably be mounted on a base and be so positioned that, when the cathode box is positioned thereon, the anodes are located in the pockets of the cathode box. The anodes, and the base, may be made of a film-forming metal or alloy thereof, that is titanium, niobium, zirconium, tantalum or tungsten or alloy thereof, and the anodes may carry a surface coating of an electroconducting electrocatalytically active material, for example, a coating comprising a platinum group metal and/or a platinum group metal oxide. A preferred coating is a mixed oxide coating of a platinum group metal oxide and a film-forming metal oxide, e.g $RuO_2$ and $TiO_2$. In the electrolytic cell an anolyte header may be positioned on top of the cathode box, the header being equipped with a port through which electrolyte may be fed to the anode compartments of the cell and ports through which gaseous products of electrolysis and depleted electrolyte may be removed from the cell.

The invention is now illustrated by the following drawings in which

Figure 2:
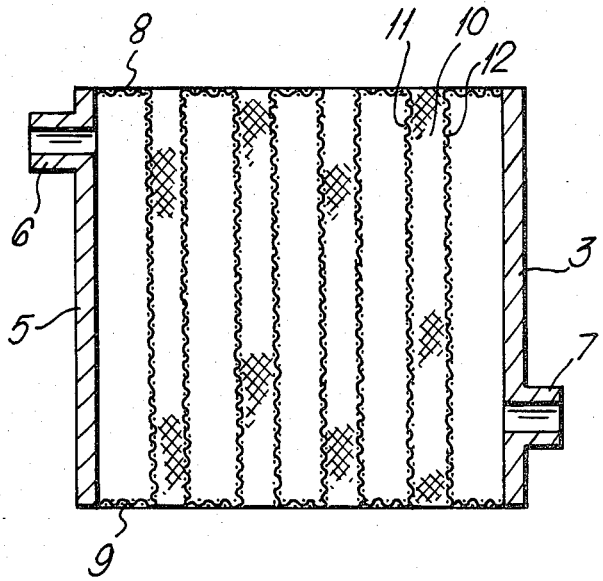

FIG. 1 illustrates a plan view of the cathode box which is to be clad with a separator in the method invention, FIG. 2 illustrates a cross-sectional view in elevation of the cathode box along the line A—A of FIG. 1.

Figure 3:
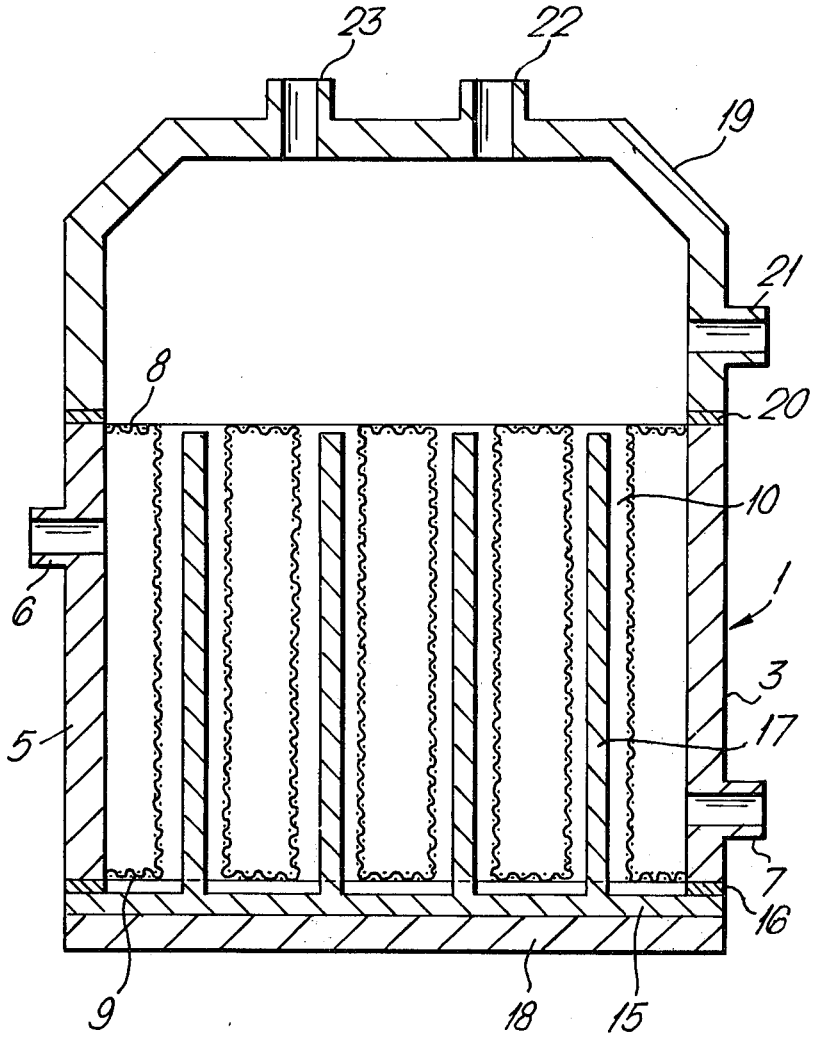
Figure 4:
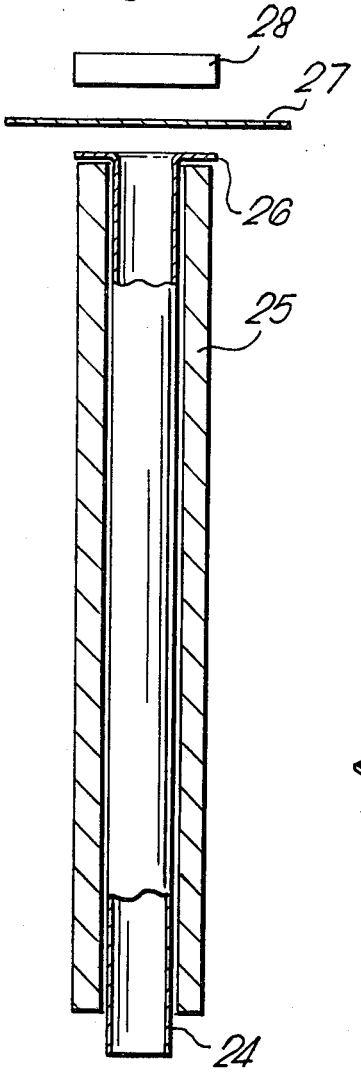
Figure 5:
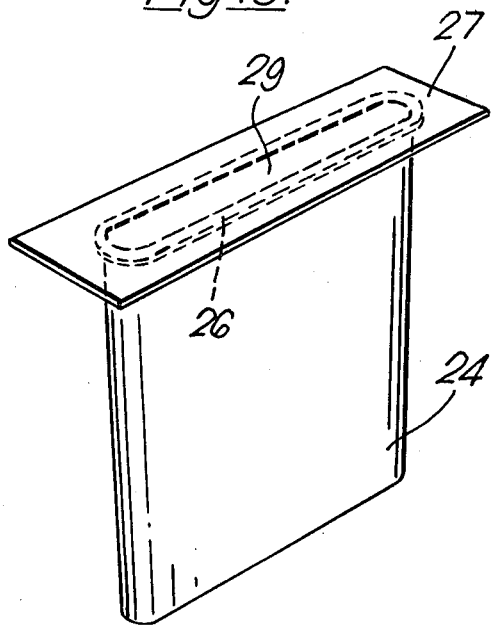
Figure 6:
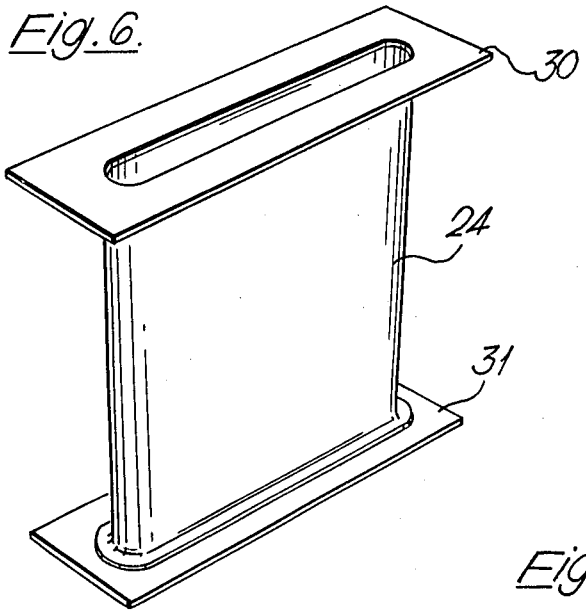
Figure 7:
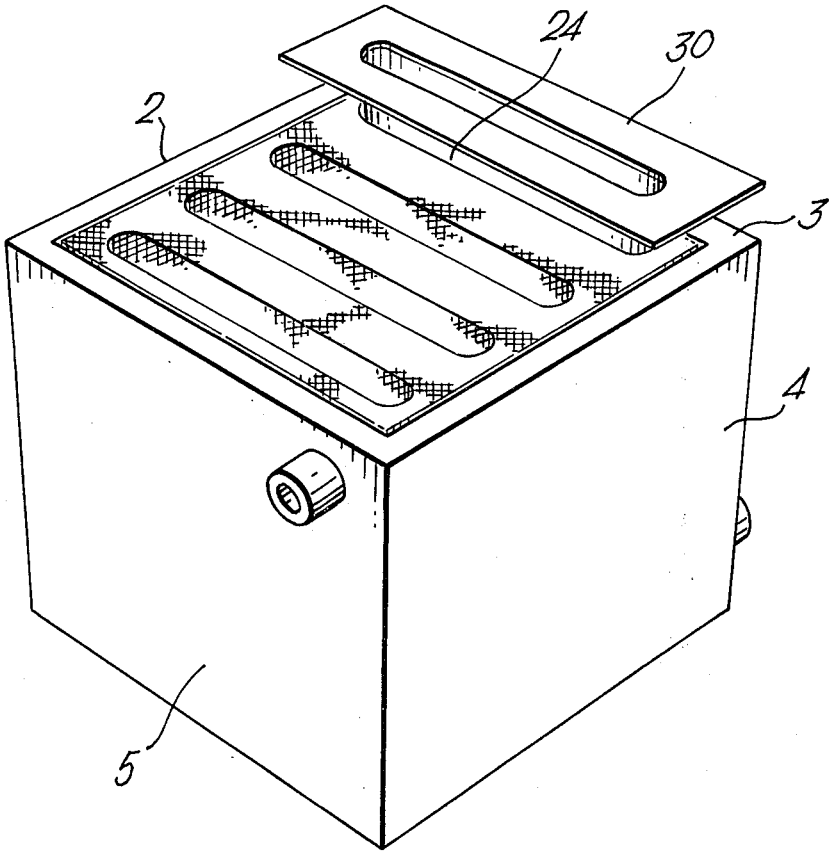
Figure 8:
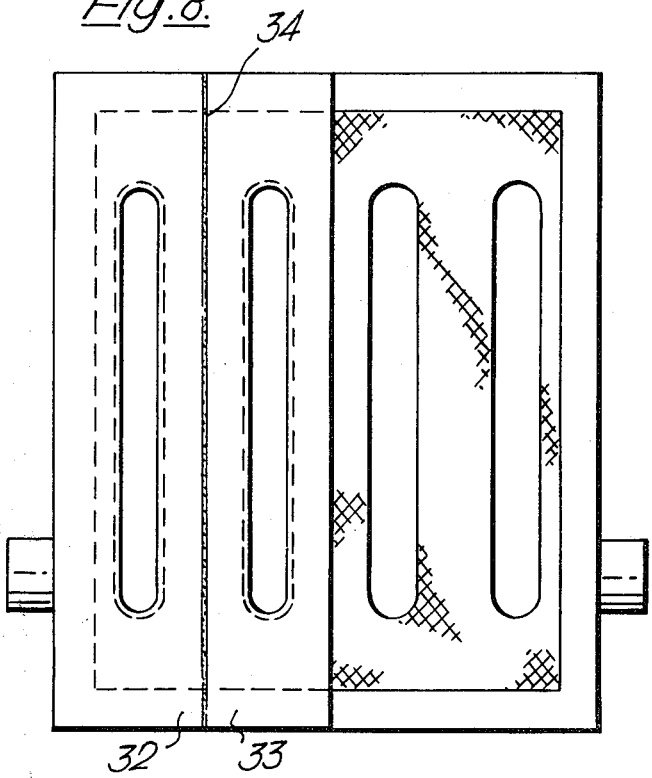
Figure 9:
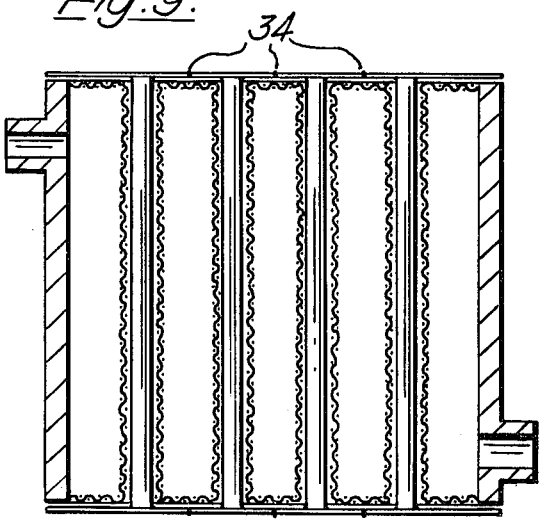

FIG. 3 illustrates a cross-sectional view in elevation of an electrolytic cell, for the sake of convenience the separator having been omitted from the cell which is shown, FIGS. 4 and 5 illustrate diagrammatic views showing the production of a flared sleeve for use in the method of the invention, FIG. 6 illustrates an isometric view of a flared sleeve, FIG. 7 illustrates an isometric view of a cathode box with a flared sleeve positioned in one of the pockets of the box FIG. 8 illustrates a plan view of a cathode box with two of the pockets of the cathode box clad with flared sleeves, and FIG. 9 illustrates the cathode box of FIG. 2 with flared sleeves positioned in adjacent pockets of the cathode box sealed to each other.

Referring to FIGS. 1 to 3 the cathode box (1) comprises side walls (2,3,4,5) equipped with ports (6,7) through which water or other liquid may be fed to the cathode box and through which liquid and gaseous products of electrolysis may be removed from the cathode box, a foraminate top (8), and a foraminate base (9). The foraminate structure may be an expanded metal but in the embodiment illustrated it is a woven wire mesh, suitably of mild steel where the cell is to be used for the electrolysis of an aqueous alkali metal chloride solution. The cathode box comprises four pockets (10) which are parallel to each other and which are elongated in shape and which are formed by side walls (11,12) and end walls (13,14) between the foraminate top (8) and foraminate base (9) of the cathode box. For the sake of convenience in the embodiment illustrated the cathode box has been shown as comprising four pockets only. It is to be understood that the cathode box may comprise a much larger number of pockets, for example forty or more such pockets. The cathode box is also equipped with an electrical connection which for the sake of convenience is not shown.

The electrolytic cell shown in FIG. 3 comprises a cathode box (1) which is positioned on a base plate (15) and insulated therefrom by a gasket (16) of an electrically insulating material which is resistant to corrosion by the liquors in the cell. A plurality of anodes (17) are mounted on the baseplate (15). The anodes are parallel to each other and positioned in the pockets (10) of the cathode box. A base (18) through which electrical power may be fed to the anodes of the cell is in electrical contact with the baseplate (16). The connection of the power source is conventional and for the sake of convenience is not shown.

Where the electrolytic cell is to be used in the electrolysis of aqueous alkali metal chloride solution the anodes (17) and the baseplate (16) may suitably be made of a film-forming metal, for example titanium, and the anode surfaces may be foraminate and may suitably be coated with a layer of an electro-conducting electrocatalytically active material of the type hereinbefore described.

An anolyte header (19) is positioned on the cathode box (1) and insulated therefrom by means of a gasket (20) of an electrically insulating material which is resistant to corrosion by the liquors in the cell. The anolyte header (19) is equipped with three ports (21,22,23). through which, respectively, electrolyte solution may be fed to the cell and gaseous products of electrolysis and depleted electrolyte solution may be removed from the cell.

Referring to FIG. 4, a sleeve of a separator material (24) formed by sealing together opposite edges of an oblong-shaped sheet, is positioned within an electrode (25) which has the same general shape as that of a pocket of the cathode box, and the end (26) of the sleeve (24) is folded so as to be flared outwardly over the end of the electrode. An oblong shaped sheet (27) of separator material is then contacted with the end (26) of the sleeve and finally a second electrode (28) is positioned over the the sheet (27). The electrodes (25, 28) are connected to a suitable high frequency source of electrical power (not shown), a high frequency alternating magnetic field is created between the electrodes, pressure is applied through the electrodes to the sheet (27) and the end (26) of the sleeve, and the sheet is sealed to the sleeve by radio frequency heating. The electrodes are then removed and the part (29) in-board of the seal, as shown in FIG. 5, is removed, suitably by cutting the sheet of separator material (27) with a knife. Thereafter the above procedure is repeated and a sheet of separator material is sealed to the opposite end of the sleeve and the part of the sheet inboard of the seal is removed in order to produce a sleeve of separator material (24) having two flared ends (30,31) as shown in FIG. 6.

Referring to FIG. 7, a separator comprising a sleeve (24) and flared ends (30, one not shown) is positioned in a pocket of the cathode box. The flared end (30) is sufficiently large to project over the walls (2,3,4) of the cathode box, and likewise the flared end (31) which is not shown, projects over the walls (2,3,4).

Referring to FIG. 8 two separator sleeves each of which have flares at both ends (32,33 two not shown) are placed in adjacent pockets of the cathode box and parts of the flared ends of sleeves in adjacent cathode pockets are placed in face-to-face contact along the line (34) and the parts (34) in contact are positioned between a pair of linear electrodes and sealed to each other by means of radio frequency heating. Thereafter flared sleeves are positioned in the other pockets of the cathode box and the flared ends of each sleeve are sealed by radio frequency heating to the flared end of the sleeves in the adjacent pockets so that all the pockets and the upper surface of the cathode box are clad with separator. Finally, the flared ends of the sleeves on the lower surface of the cathode box are sealed to each other by radio frequency heating as described in order to clad the lower surface of the cathode box.

The clad cathode box is shown in FIG. 9. The face-to-face seals between flared ends of sleeves in adjacent pockets of the cathode box being shown at (34).

In order to assemble the electrolytic cell the cathode box (1) clad with separator is placed on the baseplate (16) and the anolyte header (19) is placed on the cathode box in the manner hereinbefore indicated, and the cell is bolted together.

The electrolytic cell is operated by feeding aqueous alkali metal chloride solution to the anolyte header (19) through port (21) and gaseous chlorine produced in electrolysis is removed through port (22). Depleted alkali metal chloride solution may if necessary be removed through port (23). Where the separator is a hydraulically permeable diaphragm the solution of alkali metal chloride passes through the diaphragm and hydrogen and a solution of alkali metal hydroxide containing alkali metal chloride are removed from the cathode box through port (6). Where the separator is a substantially hydraulically impermeable ion exchange membrane water or dilute alkali metal hydroxide solution is fed to the cathode box through a port (7) and hydrogen and aqueous alkali metal hydroxide solution are removed from the cathode box through port (6).

A cathode box of the type described was clad with a membrane material comprising a film of copolymer of tetrafluoroethylene and a perfluorovinyl ether carboxylic ester, and thereafter the carboxylic ether groups in the membrane were converted to the sodium salt form by contacting membrane with aqueous sodium hydroxide solution. The heat sealing was effected using a radio frequency heating apparatus (Radyne Ltd) at a frequency of 27 megacycles per second and a heating time for each seal of 3 minutes.

The cathode box was then assembled in an electrolytic cell of the type described equipped with titanium anodes having a coating of mixture of $RuO_2$ and $TiO_2$ (35:65 weight:weight) and saturated aqueous sodium chloride solution was electrolysed at an anode current density of 2.9 kA/m$^2$, a temperature of 85° C. and a voltage of 3.8 volts. Water was charged to the cathode compartment during the electrolysis and 35% by weight sodium hydroxide solution was produced at a current efficiency of 95%. The sodium hydroxide solution contained 10 parts per million of sodium chloride indicating that there was no leakage of sodium chloride electrolyte from the anode compartment to the cathode compartment.

I claim:

1. A method of cladding a separator to a cathode box of the pocket type for use in an electrolytic cell, the cathode box comprising side walls, a top and bottom, and a plurality of pockets substantially parallel to each other and formed by foraminate walls positioned between the top and bottom, in the method a separator in the form of a sleeve is positioned in each pocket of the cathode box with the ends of the sleeves projecting beyond the ends of the pockets, characterised in that those parts of the sleeves projecting beyond the ends of adjacent pockets in a first direction are heat sealed to each other or to additional heat sealable material, those parts of the sleeves projecting beyond the ends of adjacent pockets in the opposite direction are heat sealed to each other or to additional heat sealable material, and in that the heat sealing is effected by means of radio frequency heating.

2. A method as claimed in claim 1 characterised in that heat sealing is effected by means of radio frequency heating at a frequency in the range 10 to 50 cycles per second.

3. A method as claimed in claim 1 or claim 2 characterised in that the separator is a hydraulically permeable diaphragm.

4. A method as claimed in claim 1 or claim 2 characterised in that the separator is a substantially hydraulically impermeable ionically permselective membrane.

5. A method as claimed in claim 1 characterised in that the ends of the sleeves are flared and in that the flared ends of sleeves in adjacent pockets are contacted and heat sealed to each other by means of radio frequency heating.

6. A method as claimed in claim 1 characterised in that each of the sleeves comprise a plurality of tabs on the edges thereof and in that the edges and the tabs of sleeves in adjacent pockets are sealed to each other by means of radio frequency heating.

7. A method as claimed in claim 1 characterised in that sleeves are heat sealed by means of radio frequency heating to the slots of slotted sheets of a reat sealable material positioned over the upper and lower surfaces of the cathode box.

8. A method as claimed in claim 7 characterised in that the slotted sheets are formed of an organic polymeric material.

9. A method as claimed in claim 7 or claim 8 characterised in that the separator is a diaphragm and in that the slotted sheets are made of a hydraulically permeable material which functions as a diaphragm.

10. A method as claimed in claim 7 or claim 8 characterised in that the separator is an ionically permselective membrane and in that the slotted sheets are made of an ionically permselective material which functions as a membrane.

11. A cathode box clad with a separator by a method as claimed in claim 1.

12. An electrolytic cell comprising a cathode box having a plurality of pockets therein substantially parallel to each other and formed by foraminate walls, a plurality of anodes substantially parallel to each other and positioned in the pockets of the cathode box, characterised in that the cathode box is clad with a separator by a method as claimed in claim 1.

* * * * *